US009648435B2

(12) United States Patent
Honda et al.

(10) Patent No.: US 9,648,435 B2
(45) Date of Patent: May 9, 2017

(54) SOUND-SOURCE SEPARATION METHOD, APPARATUS, AND PROGRAM

(71) Applicant: KYOEI ENGINEERING CO., LTD., Agano-shi, Niigata (JP)

(72) Inventors: Yasushi Honda, Tokyo (JP); Akira Gotoh, Yokosuka (JP); Yoshitaka Murayama, Yashio (JP)

(73) Assignee: KYOEI ENGINEERING CO., LTD., Agano-Shi, Niigata (JP)

( * ) Notice: Subject to any disclaimer, the term of this patent is extended or adjusted under 35 U.S.C. 154(b) by 12 days.

(21) Appl. No.: 14/749,699

(22) Filed: Jun. 25, 2015

(65) Prior Publication Data

US 2015/0296318 A1 Oct. 15, 2015

Related U.S. Application Data

(63) Continuation of application No. PCT/JP2013/051558, filed on Jan. 25, 2013.

(51) Int. Cl.

| | |
|---|---|
| ***H04S 5/00*** | (2006.01) |
| ***H04R 3/00*** | (2006.01) |
| *G10L 21/0272* | (2013.01) |
| *H04R 1/40* | (2006.01) |

(52) U.S. Cl.

CPC ..... *H04S 5/00* (2013.01); *H04R 3/005* (2013.01); *G10L 21/0272* (2013.01); *H04R 1/406* (2013.01); *H04R 2430/20* (2013.01); *H04R 2499/11* (2013.01); *H04R 2499/15* (2013.01)

(58) Field of Classification Search

None

See application file for complete search history.

(56) References Cited

U.S. PATENT DOCUMENTS

| | | | | |
|---|---|---|---|---|
| 8,135,142 | B2 * | 3/2012 | Fischer | H04R 3/005 381/122 |
| 2009/0175466 | A1 * | 7/2009 | Elko | H04R 3/005 381/94.2 |
| 2012/0140948 | A1 * | 6/2012 | Terada | H04R 29/006 381/92 |
| 2015/0213811 | A1 * | 7/2015 | Elko | H04R 3/005 381/92 |

FOREIGN PATENT DOCUMENTS

| | | | |
|---|---|---|---|
| JP | 2-188050 | A | 7/1990 |
| JP | 2005-236407 | A | 9/2005 |
| JP | 2009-135593 | A | 6/2006 |
| JP | 2007-318528 | A | 12/2007 |
| JP | 2009-027388 | A | 2/2009 |

* cited by examiner

*Primary Examiner* — Paul Huber

(74) *Attorney, Agent, or Firm* — Nath, Goldberg & Meyer; Jerald L. Meyer; Stanley N. Protigal

(57) ABSTRACT

Filtering containing a delay by a specific time is performed on one of the pair of input signals are input from microphones L, R. After the filtering, a pair of input signals InL and InR are alternately interchanged for each sampling by an interchanging circuit 2 to generate a pair of interchanged signals InA and InB. The one interchanged signal InB is multiplied by a coefficient m by an coefficient updating circuit 3 to generate an error signal of the interchanged signals InA and InB. The recurrence formula of the coefficient m containing the error signal is calculated to update the coefficient m for each sampling. The pair of input signals InL and InR are multiplied by the sequentially updated coefficient m and are output.

15 Claims, 8 Drawing Sheets

SOUND-SOURCE SEPARATION METHOD, APPARATUS, AND PROGRAM

CROSS-REFERENCE TO RELATED APPLICATIONS

This application is a Continuation of PCT Application No. PCT/JP2013/051558, filed on Jan. 25, 2013, the entire content of which is incorporated herein by reference.

TECHNICAL FIELD

The present disclosure relates to sound-source separation method, apparatus, and program that form a directivity toward a sound source located in an arbitrary direction based on a sound wave signal.

BACKGROUND ART

In order to precisely separate sound waves of a target sound source, and to suppress target external sound like noises, in general, it is necessary to apply a directional microphone, and to dispose the plural directional microphones side by side at equal to or wider than a certain pitch. However, in the case of a compact sound collector device like an IC recorder, it is difficult to apply the sound collecting technology of employing a directional microphone and of utilizing the plural microphones with a wide pitch. In addition, a precise sound-source separation by an application of such a sound collecting technologies to recorded sound from plural sound sources and having undergone an artificial down-mix process is also difficult.

Hence, a large number of technologies of analyzing an amplitude difference and a phase difference between signals output by respective microphones after recording of sound wave, and performing a signal processing in accordance with an analysis result, thereby separating and extracting a target sound source have been proposed. In recent years, a statistical analysis, a frequency analysis, a complex analysis, etc., are applied to detect a difference in waveform structure of input signals, and the detection result is utilized for a sound-source separation process.

For example, a signal processing such that a conversion from a time axis to a frequency axis is performed on an input signal, a phase difference for each frequency is calculated, a frequency band of an input sound wave from a target sound source is specified based on the calculated difference, and the sound wave within that frequency band is emphasized is performed (see Patent Document 1).

In addition, in the signal processing, it is determined whether or not an input sound wave is in a target direction based on input signals from two microphones closely disposed to each other, a phase difference between the two input signals is corrected, thereby emphasizing sound present in the target direction (see Patent Document 2). The two input signals are referred to each other, and a filter is sequentially updated based on an obtained signal (see Patent Document 3).

SUMMARY OF INVENTION

Technical Problem

Downsizing of sound collector devices or devices equipped with the sound collector device involves a further narrowing of the disposing pitch of microphones, and thus an amplitude difference and a phase difference between signals are quite small. Hence, a large amount of efforts to clearly specify such amplitude difference and phase difference is necessary. This is particularly remarkable in a low-frequency range that has a longer wavelength of several ten times or more than the pitch of two microphones, and in a high-frequency range where the phase difference of sound wave reaching the two microphones becomes equal to or longer than a cycle.

In recent years, as disclosed in Patent Documents 1 to 3, the frequency analysis, the complex analysis, or the statistical analysis to a waveform structure is becoming highly sophisticated, thereby coping with the narrow disposing pitch of microphones. However, the sophistication of the analysis results in an elongation of a frame length, a large number of delay devices, a long filter length, and a long filter coefficient in the case of a conversion to a frequency range. Hence, because of the capacity of the arithmetic processing performance, it becomes difficult to form a real-time directivity. In order to reduce the arithmetic processing load, the number of microphones can be increased, but due to the limited dimension of a device, the pitch between microphones becomes further narrow.

The present disclosure has been made in order to address the above-explained technical problems of conventional technologies, and it is an objective of the present disclosure to provide sound-source separation method, apparatus, and program which can emphasize or suppress and output sound coming from an arbitrary direction with a little amount of calculation using microphones closely disposed to each other and without a highly sophisticated analysis.

Solution to Problem

To accomplish the above objective, a sound-source separation method according to an embodiment is to form a directivity in a specific direction relative to a pair of input signals, and the method includes:

a filtering step of filtering containing a delay by a specific time on one of the pair of input signals;

an interchanging step of, after the filtering step, alternately interchanging the pair of input signals through an interchanging circuit for each sampling, and generating a pair of interchanged signals;

a generating step of multiplying one of the interchanged signals by a coefficient m, and generating an error signal between the interchanged signals;

an updating step of calculating a recurrence formula of the coefficient m containing the error signal, and updating the coefficient m for each sampling; and an outputting step of multiplying the pair of input signals by the sequentially updated coefficient m and outputting resultant signals, in which:

the specific time in the filtering step is equivalent to a time difference of sound wave that reaches a pair of microphones from the specific direction; and in the filtering step, the pair of input signals originating from the sound wave from the specific direction is adjusted so as to have a same amplitude and a same phase.

In the filtering step, filtering may be performed on the one of the pair of input signals by a transfer function T1 that delays the input signal by the specific time, and when a transfer function of sound wave from the specific direction to the microphone which outputs the input signal subjected to filtering is C11, and a transfer function of the sound wave to the other microphone is C12, the transfer function T1 may substantially satisfy T1×C11=C12.

The sound-source separation method may further include a delaying step of causing, to the other one of the pair of input signals, a delay time that is equal to or longer than a necessary time for sound wave to travel a distance between the pair of microphones, in which in the filtering step, filtering may be performed on the one of the pair of input signals, the filtering containing a time delay obtained by adding the delay time by the delaying step and the specific time.

In the filtering step, filtering may be performed on the one of the pair of input signals by a transfer function T1 that delays the input signal by a specific time, in the delaying step, the other one of the pair of input signals may be delayed by a transfer function D1 that delays the input signal by the delay time, and when a transfer function of sound wave from the specific direction to the microphone which outputs the input signal subjected to filtering is C11, and a transfer function of the sound wave to the other microphone is C12, the transfer function T1 and the transfer function D1 may substantially satisfy T1×C11=D1×C12.

In the generating and updating steps:

one of the interchanged signals may be caused to pass through a first integrator set with −1 time of a past coefficient m calculated one sampling before;

after through the first integrator, the pair of interchanged signals may be caused to pass through a first adder that adds those signals;

after through the first adder, the addition signal may be caused to pass through a second integrator set with a constant μ;

after through the second integrator, a resultant signal may be caused to pass through a third integrator set with the one interchanged signal before multiplied by the past coefficient m; and after through the third integrator, a resultant signal may be caused to pass through a second adder set with a past coefficient m calculated one sampling before, thereby updating the coefficient m for each sampling.

To accomplish the above objective, a sound-source separation apparatus according to an embodiment forms a directivity in a specific direction relative to a pair of input signals, and the apparatus includes:

a filter filtering containing a delay by a specific time on the one of the pair of input signals;

an interchanger alternately interchanging, after the filtering, the pair of input signals for each sampling, and generating a pair of interchanged signals;

an error signal generator multiplying one of the interchanged signals by a coefficient m, and generating an error signal between the interchanged signals;

a recurrence formula calculator calculating a recurrence formula of the coefficient m containing the error signal, and updating the coefficient m for each sampling; and an integrator multiplying the pair of input signals by the sequentially updated coefficient m and outputting resultant signals, in which:

the specific time in the filtering is equivalent to a time difference of sound wave that reaches a pair of microphones from the specific direction; and in the filtering, the pair of input signals originating from the sound wave from the specific direction is adjusted so as to have a same amplitude and a same phase.

The filter may perform filtering on the one of the pair of input signals by a transfer function T1 that delays the input signal by the specific time, and when a transfer function of sound wave from the specific direction to the microphone which outputs the input signal subjected to filtering is C11, and a transfer function of the sound wave to the other microphone is C12, the transfer function T1 may substantially satisfy T1×C11=C12.

The sound-source separation apparatus may further include a delay that causes, to the other one of the pair of input signals, a delay time that is equal to or longer than a necessary time for sound wave to travel a distance between the pair of microphones, in which the filter may perform filtering on the one of the pair of input signals, the filtering containing a time delay obtained by adding the delay time by the delaying step and the specific time.

The filter may perform filtering on the one of the pair of input signals by a transfer function T1 that delays the input signal by a specific time, the delay may delay the other one of the pair of input signals by a transfer function D1 that delays the input signal by the delay time, and when a transfer function of sound wave from the specific direction to the microphone which outputs the input signal subjected to filtering is C11, and a transfer function of the sound wave to the other microphone is C12, the transfer function T1 and the transfer function D1 may substantially satisfy T1×C11=D1×C12.

The error signal generator and the recurrence formula calculator may:

cause one of the interchanged signals to pass through a first integrator set with −1 time of a past coefficient m calculated one sampling before;

after through the first integrator, cause the pair of interchanged signals to pass through a first adder that adds those signals;

after through the first adder, cause the addition signal to pass through a second integrator set with a constant μ;

after through the second integrator, cause a resultant signal to pass through a third integrator set with the one interchanged signal before multiplied by the past coefficient m; and after through the third integrator, cause a resultant signal to pass through a second adder set with a past coefficient m calculated one sampling before, thereby updating the coefficient m for each sampling.

To accomplish the above objective, a sound-source separation program according to an embodiment causes a computer to form a directivity in a specific direction relative to a pair of input signals, and the program causes the computer to function as:

a filter filtering containing a delay by a specific time on the one of the pair of input signals;

an interchanger alternately interchanging, after the filtering, the pair of input signals for each sampling, and generating a pair of interchanged signals;

an error signal generator multiplying one of the interchanged signals by a coefficient m, and generating an error signal between the interchanged signals;

a recurrence formula calculator calculating a recurrence formula of the coefficient m containing the error signal, and updating the coefficient m for each sampling; and an integrator multiplying the pair of input signals by the sequentially updated coefficient m and outputting resultant signals, in which:

the specific time in the filtering is equivalent to a time difference of sound wave that reaches a pair of microphones from the specific direction; and in the filtering, the pair of input signals originating from the sound wave from the specific direction is adjusted so as to have a same amplitude and a same phase.

The filter may perform filtering on the one of the pair of input signals by a transfer function T1 that delays the input signal by the specific time, and when a transfer function of sound wave from the specific direction to the microphone which outputs the input signal subjected to filtering is C11, and a transfer function of the sound wave to the other microphone is C12, the transfer function T1 may substantially satisfy T1×C11=C12.

The sound-source separation program may further cause the computer to function as a delay that causes, to the other one of the pair of input signals, a delay time that is equal to or longer than a necessary time for sound wave to travel a distance between the pair of microphones, in which the filter may perform filtering on the one of the pair of input signals, the filtering containing a time delay obtained by adding the delay time by the delaying step and the specific time.

The filter may perform filtering on the one of the pair of input signals by a transfer function T1 that delays the input signal by a specific time, the delay may delay the other one of the pair of input signals by a transfer function D1 that delays the input signal by the delay time, and when a transfer function of sound wave from the specific direction to the microphone which outputs the input signal subjected to filtering is C11, and a transfer function of the sound wave to the other microphone is C12, the transfer function T1 and the transfer function D1 may substantially satisfy T1×C11=D1×C12.

The error signal generator and the recurrence formula calculator may:

cause one of the interchanged signals to pass through a first integrator set with −1 time of a past coefficient m calculated one sampling before;

after through the first integrator, cause the pair of interchanged signals to pass through a first adder that adds those signals;

after through the first adder, cause the addition signal to pass through a second integrator set with a constant μ;

after through the second integrator, cause a resultant signal to pass through a third integrator set with the one interchanged signal before multiplied by the past coefficient m; and after through the third integrator, cause a resultant signal to pass through a second adder set with a past coefficient m calculated one sampling before, thereby updating the coefficient m for each sampling.

Advantageous Effects of Invention

According to the present disclosure, by focusing on the time difference caused due to a physical disposing position of the target sound source and those of the microphones, a simple method that emphasizes sound with no dime difference can be applied to relatively emphasize sound from the target sound source present in an arbitrary direction. Hence, the number of calculations can be remarkably reduced, while at the same time, sound wave signals coming from the arbitrary direction can be precisely emphasized without a complex analyze that specifies an amplitude and a difference between signals.

DESCRIPTION OF EMBODIMENTS

Embodiments of sound-source separation method, apparatus, and program according to the present disclosure will be explained in detail with reference to figures.

(First Embodiment)

(Structure)

Figure 1:
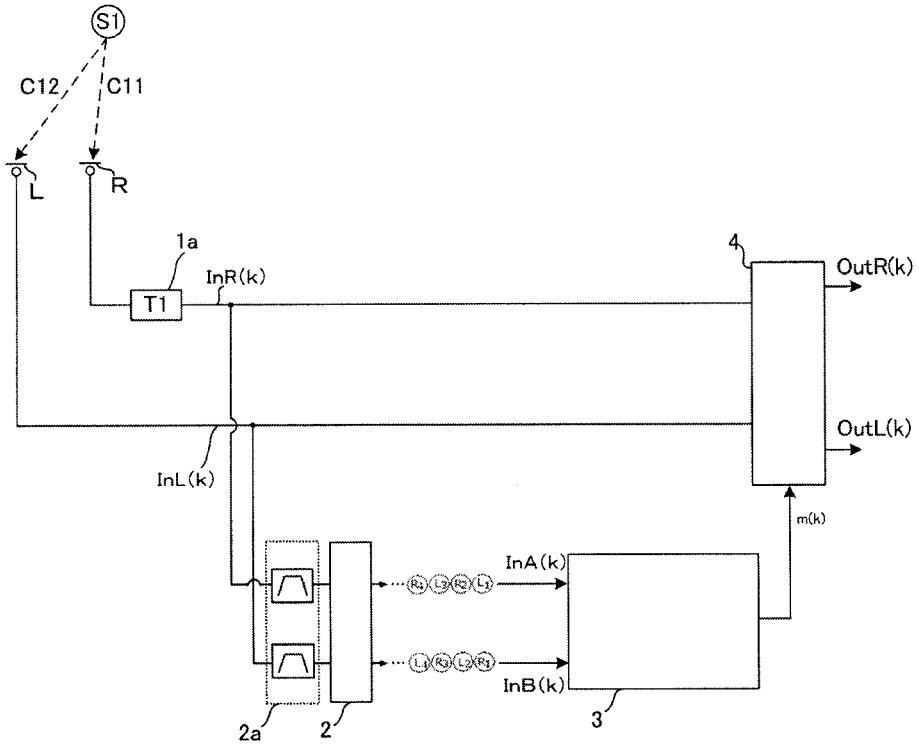
FIG. 1 is a block diagram illustrating a structure of a sound-source separation apparatus according to a first embodiment.

FIG. 1 is a block diagram illustrating a structure of a sound-source separation apparatus. As illustrated in FIG. 1, the sound-source separation apparatus is connected with a pair of microphones L and R disposed and spaced from each other, and input signals InL(k) and InR(k) from the microphones L and R are input to the sound-source separation apparatus. The sound-source separation apparatus performs a signal processing on those input signals InL(k) and InR(k), and emphasizes sound wave in a specific direction where a target sound source S1 is present relative to sound waves coming from other directions. In this embodiment, the target sound source S1 is located in a specific direction in front of the microphones L and R or near the microphone R except the front location of those microphones.

This sound-source separation apparatus includes a filter 1*a* at the subsequent stage to the microphone R located near the target sound source S1. The filter 1*a* delays the time waveform of the input signal InR(k) by a specific time represented by a transfer function T1. This filter 1*a* is, for example, an FIR filter or an IIR filter.

The transfer function T1 of the filter 1*a* can be expressed by the following formula (1). In this formula, C11 is a transfer function of a path from the target sound source S1 in the specific direction to the microphone R. C12 is a transfer function of a pass from the target sound source S1 in the specific direction to the microphone L.

$$C11\times T1\cong C12 \quad (1)$$

By the transfer function T1 that satisfies this formula (1), the filter 1*a* adjusts the input signal InL(k) and the input signal InR(k) obtained by recording sound wave from the target sound source S1 in the specific direction to have the same amplitude and the same phase, and adds a time difference to an input signal In(L) and an input signal In(R) obtained by recording sound wave coming from a direction out of the specific direction. In this case, the more the direction out of the specific direction is, the larger the time difference to be added becomes.

That is, the transfer function T1 is adjusted in such a way that a delay time represented by the transfer function T1 becomes equivalent to a time difference of the same sound wave reaching the microphones L and R from the target sound source S1.

The input signal InR(k) input from the microphone R and having passed through the filter 1*a*, and the input signal InL(k) input from the microphone L are distributed to a route where a characteristic correcting circuit 2*a*, an interchanging circuit 2, and a coefficient updating circuit 3 are connected in series, and a route directed to a synthesizing circuit 4. In addition, this sound-source separation apparatus performs a process of adding, to the input signal InL(k) input from the microphone Land the input signal InR(k) output by the filter 1*a*, a gain based on a time difference between the input signal InL(k) and the input signal InR(k) using those interchanging circuit 2, coefficient updating circuit 3, and synthesizing circuit 4.

The characteristic correcting circuit 2*a* includes a frequency-characteristic correcting filter, and a phase-characteristic correcting circuit. The frequency-characteristic correcting filter extracts a sound wave signal in a desired frequency band. The phase-characteristic correcting circuit decreases an effect of the acoustic characteristics of the microphones L and R to the input signal InL(k) and the input signal InR(k).

The interchanging circuit 2 alternately interchanges and outputs the input signal InL(k) and the input signal InR(k) for each sampling. That is, the data sequence of an interchanged signal InA(k) and that of an interchanged signal InB(k) become as follow where k=1, 2, 3, 4 and the like.

InA(k)={InL(1) InR(2) InL(3) InR(4) . . . }

InB(k)={InR(1) InL(2) InR(3) InL(4) . . . }

The interchanged signal InA(k) and the interchanged signal InB(k) are input to the coefficient updating circuit 3. This coefficient updating circuit 3 calculates an error between the interchanged signal InA(k) and the interchanged signal InB(k), and sets a coefficient m(k) in accordance with the error. In addition, the coefficient updating circuit 3 sequentially updates the coefficient m(k) with reference to a past coefficient m(k−1).

An error signal e(k) between the interchanged signal InA (k) and the interchanged signal InB(k) reaching at the same time is defined as the following formula (2).

$$e(k)=InB(k)-m(k-1)\times InA(k) \quad (2)$$

This coefficient updating circuit 3 searches the coefficient m(k) that minimizes the error signal e(k) by calculating a recurrence formula between adjacent two terms of the coefficient m(k) containing the error signal e(k) with the error signal e(k) being as the function of the coefficient m(k−1). The larger the time difference between the input signal InL(k) and the input signal InR(k) is, the more the coefficient updating circuit 3 updating the coefficient m(k) decreases such a coefficient, and approximates the coefficient m(k) to 1 when there is no time difference through the arithmetic processing.

The coefficient m(k) is input to the synthesizing circuit 4 together with the input signal InL(k) and the input signal InR(k). The synthesizing circuit 4 multiplies the input signal InL(k) and the input signal InR(k) by the coefficient m(k) at an arbitrary ratio, and adds together at an arbitrary ratio, thereby outputting resultant output signal OutL(k) and output signal OutR(k).

Figure 2:
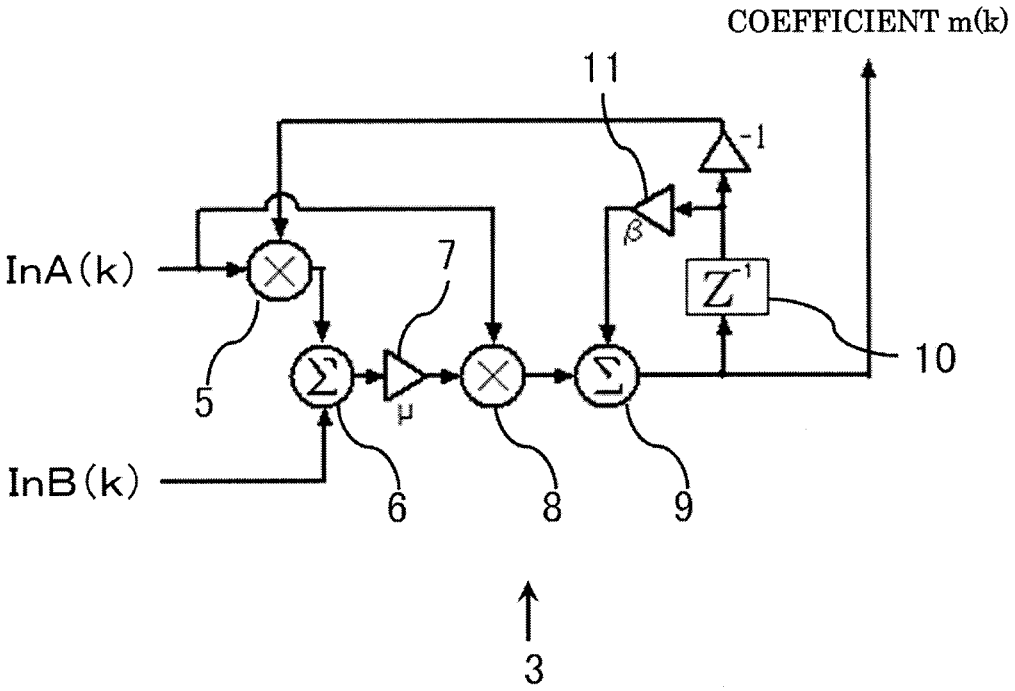
FIG. 2 is a block diagram illustrating an example coefficient updating circuit.

An example coefficient updating circuit 3 will be further explained. FIG. 2 is a block diagram illustrating an example coefficient updating circuit 3. As illustrated in FIG. 2, the coefficient updating circuit 3 includes plural integrators and adders, and is a circuit that realizes the recurrence formula of adjacent two terms, and, sequentially updates the coefficient m(k) with reference to the past coefficient m(k−1). In the coefficient updating circuit 3, an adaptive filter with a long tap number is eliminated.

In this coefficient updating circuit 3, the error signal e(k) is generated using the interchanged signal InB(k) as a reference signal. That is, the interchanged signal InA(k) is input to an integrator 5. The integrator 5 multiplies the interchanged signal InA(k) by −1 time of the coefficient m(k−1) one sampling before. An adder 6 is connected to the output side of the integrator 5. The signal output by the integrator 5 and the interchanged signal InB(k) are input to this adder 6, and those signals are added together to obtain a momentary error signal e(k). The error signal e(k) through this arithmetic processing can be expressed as the following formula (3).

$$e(k)=-m(k-1)\times InA(k)+InB(k) \quad (3)$$

The error signal e(k) is input to an integrator 7 that multiplies the input signal by μ times. The coefficient) μ is a step-size parameter that is smaller than 1. An integrator 8 is connected to the output side of the integrator 7. The interchanged signal InA(k) and a signal μe(k) that has passed through the former integrator are input to the integrator 8. This integrator 8 multiplies the interchanged signal InA(k) by the signal μe(k), and obtains a differential signal $\partial E(m)^2/\partial m$ of momentary square error that is expressed by the following formula (4).

$$\partial E(m)^2/\partial m=\mu\times e(k)\times InA(k) \quad (4)$$

An adder 9 is connected with the integrator 8. The adder 9 completes the coefficient m(k) by calculating the following formula (5), and sets the coefficient m(k) to the synthesizing circuit 4 that generates output signals OutL(k) and OutInR (k) from the input signal InL(k) and InR(k).

$$m(k)=m(k-1)\times\beta+\partial E(m)^2/\partial m \quad (5)$$

That is, the adder 9 adds a signal $\beta\cdot m(k-1)$ to the differential signal $\partial E(m)^2/\partial m$, thereby completing the coefficient m(k).

A delay device 10 that delays the signal by what corresponds to a sampling, and an integrator 11 that integrates a constant β are connected to the output side of the adder 9, and the integrator 11 multiplies the coefficient m(k−1) updated through the signal processing one sampling before by the constant β, and thus the signal $\beta\cdot m(k-1)$ is generated.

Hence, according to the coefficient updating circuit 3, the arithmetic processing of the following recurrence formula (6) is realized, the coefficient m(k) is generated, and is sequentially updated for each sampling.

$$m(k)=m(k-1)\times\beta+(-m(k-1)\times InA(k)+InB(k))\times\mu\times InA(k) \quad (6)$$

(Action)

Figure 3:
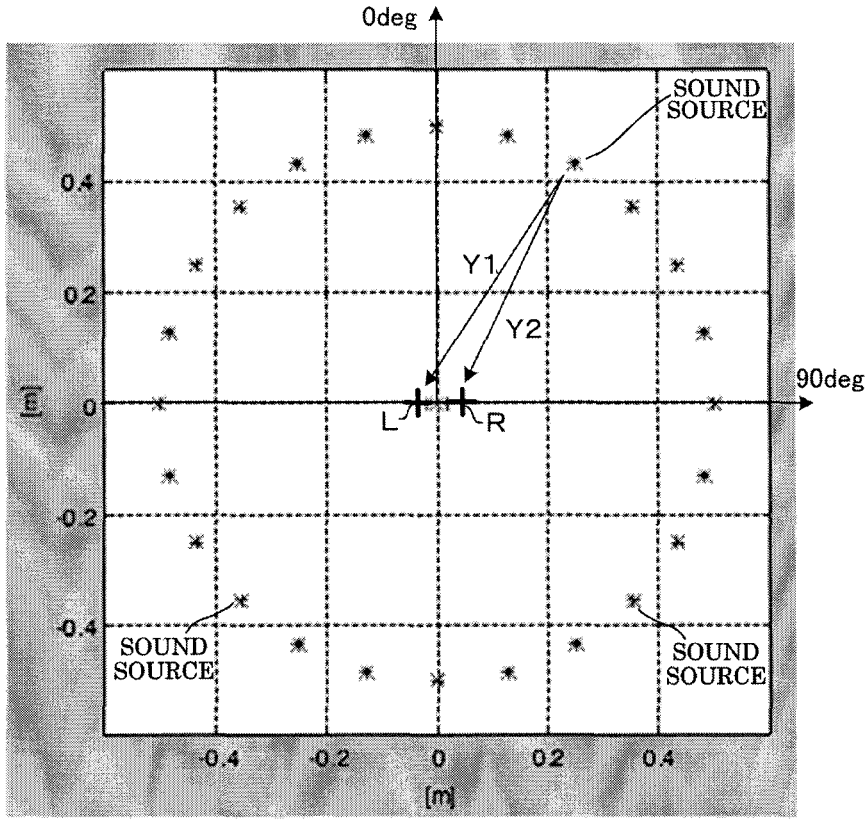
FIG. 3 is a model showing a relationship among a sound source, and microphones L and R.

FIG. 3 illustrates a relationship among each sound source, and the microphones L and R. According to a model that represents this positional relationship, the microphones L and R are disposed on an x-axis 4 cm apart from each other relative to the original as the center, and a large number of sound sources are disposed on the circle that has a radius of 0.5 m around the origin. Each sound source is specified by an angle with the y-axis positive direction being as 0 deg, and the x-axis positive direction being as 90 deg.

Figure 4:
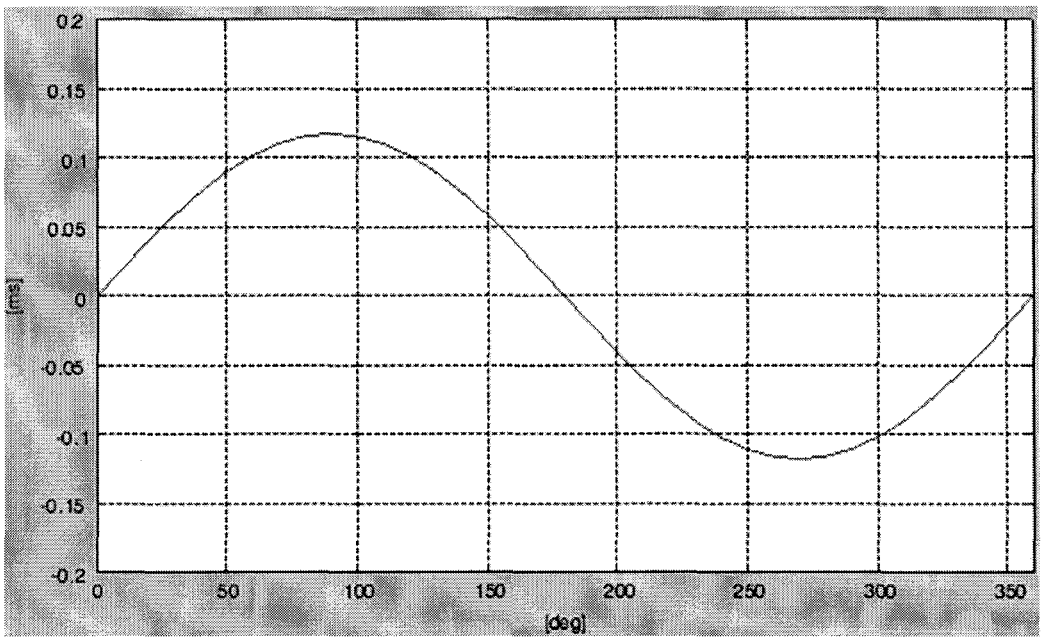
FIG. 4 is a graph showing a difference in reaching time of the same sound wave coming from each sound source.

It is presumed that a sound velocity is 340 m/s, and a transfer time to the microphone L from each sound source is Y1. In addition, a transfer time to the microphone R from each sound source is presumed as Y2. In this case, a time difference calculated by (Y1−Y2), i.e., a delay time of sound wave which has reached the microphone R and which then reaches the microphone L can be expressed by a graph of FIG. 4. In FIG. 4, the horizontal axis represents the position of the sound source, while the vertical axis represents a delay time.

As illustrated in FIG. 4, sound waves from 0 deg and 180 deg reach the microphones L and R at the same time, but sound waves from 90 deg and 270 deg reach the microphones L and R with the maximum delay. In the case of 90 deg, sound wave reaching the microphone R is faster. In the case of 270 deg, sound wave reaching the microphone R is slower. In addition, sound wave from 80 deg reaches the microphone L with the delay of 0.1159 ms after reaching the microphone R.

Figure 5:
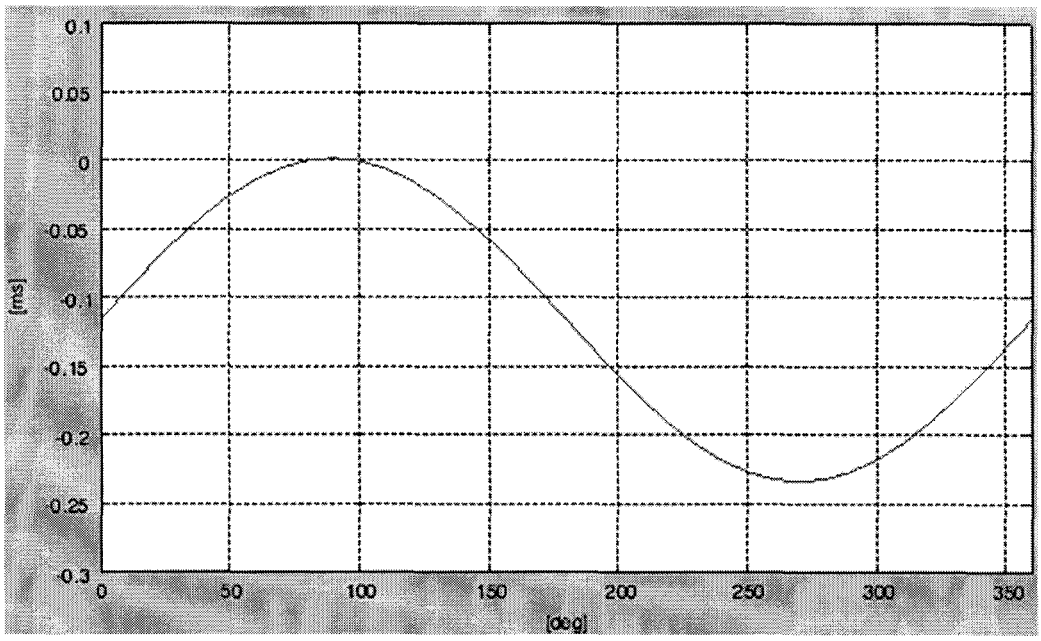
FIG. 5 is a graph showing a change in difference in reaching time when either the same sound wave coming from each sound wave is delayed.

In this case, the filter 1*a* delays the input signal InR(k) that has reached the microphone R. It is presumed that the transfer function T1 applies a delay of 0.1159 ms that is a time difference of the same sound wave which reaches the microphones L and R from 80 deg. In this case, as illustrated in FIG. 5, a time difference between the input signal InL(k) and the input signal InR(k) obtained by recording sound wave from 80 deg becomes zero.

That is, the input signal InL(k) and the input signal InR(k) that have come from 80 deg and output by the microphones L and R have the same amplitude and the same phase in a time waveform, thus emphasized relative to each other FIGS. 6 to 9 show example convergences of the coefficient m(k) through the filter 1*a* that has such a transfer function T1. In each figure, the horizontal axis represents a sampling number, and the vertical axis represents the coefficient m(k), and the way of convergence of the coefficient m(k) when the coefficient m(0) is set to be zero beforehand is shown. The pitch between the microphones L and R is 40 mm. The constant β is 1.000, the constant μ is 0.01, and the coefficient m(k) is smoothed through averaging.

Figure 6:
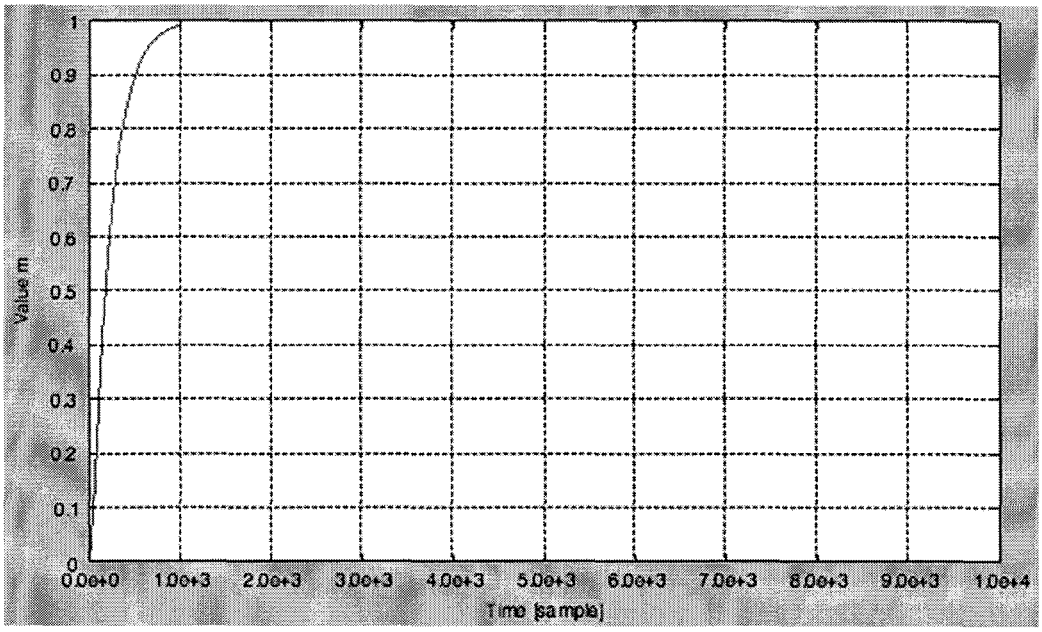
FIG. 6 is a graph showing how a coefficient m(k) generated based on an input signal from a sound source in an 80-degree direction converges when a time difference from the sound source in the 80-degree direction is eliminated.
Figure 7:
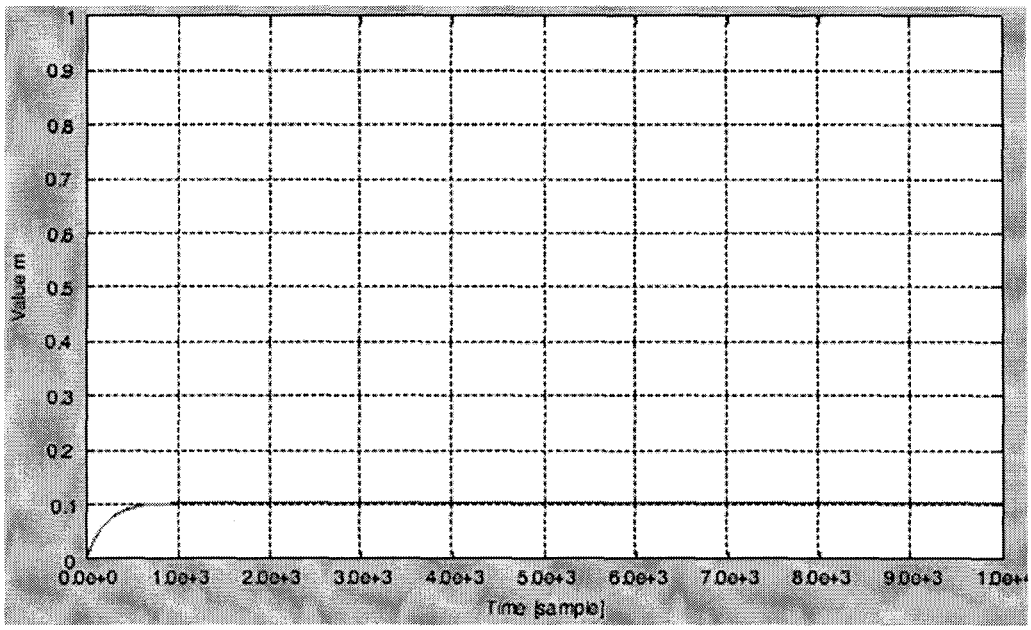
FIG. 7 is a graph showing how a coefficient m(k) generated based on an input signal from a sound source in an 270-degree direction converges when a time difference from the sound source in the 80-degree direction is eliminated.
Figure 8:
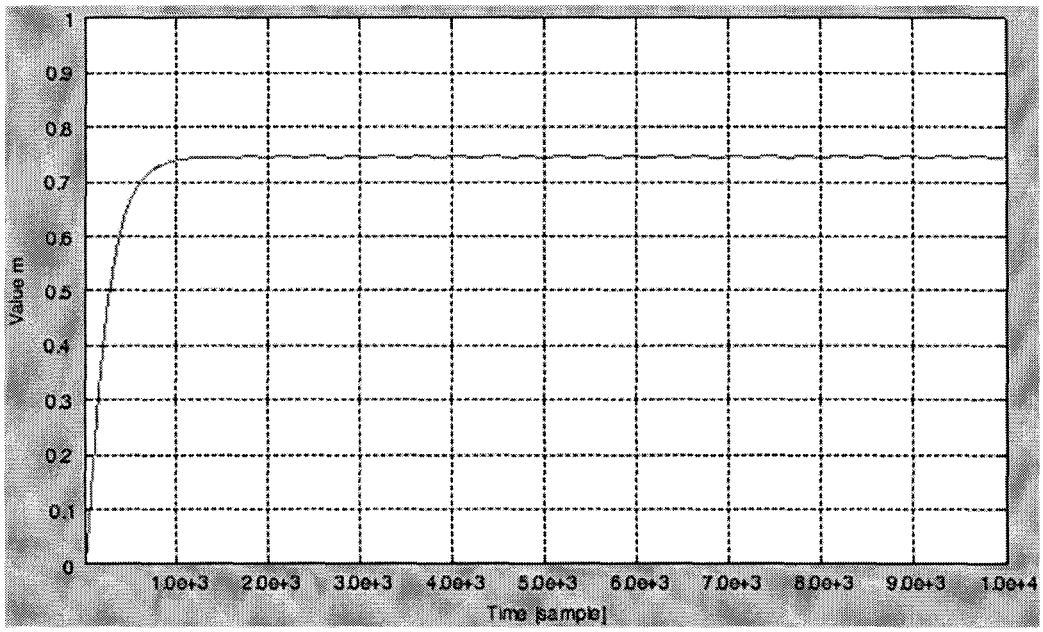
FIG. 8 is a graph showing how a coefficient m(k) generated based on an input signal from a 0-degree direction when a time difference from the sound source in the 80-degree direction is eliminated.
Figure 9:
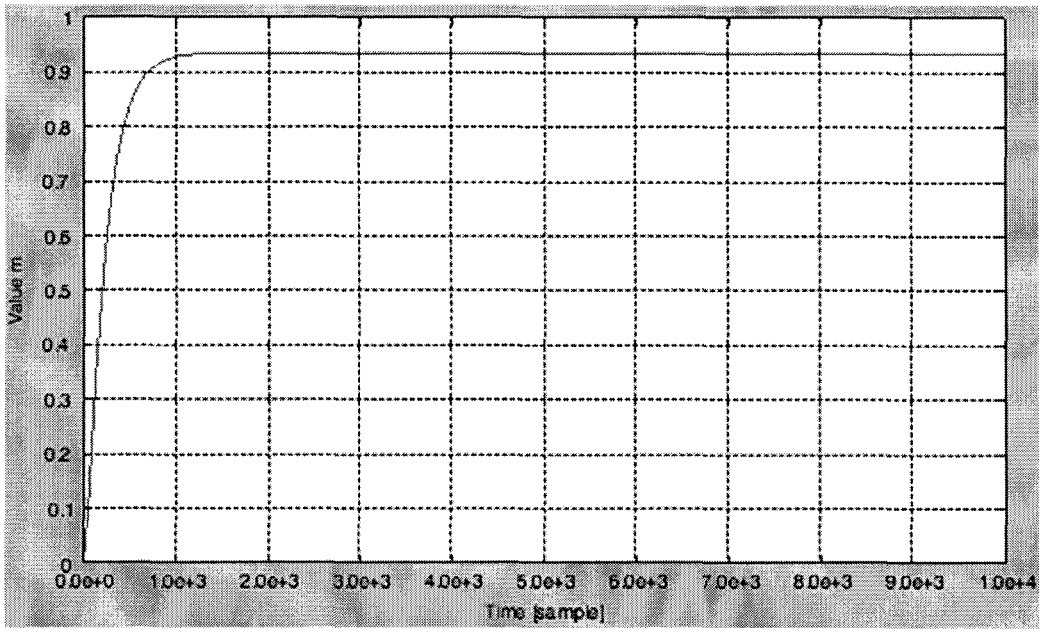
FIG. 9 is a graph showing how a coefficient m(k) generated based on an input signal from a 30-degree direction when a time difference from the sound source in the 80-degree direction is eliminated.

First, as illustrated in FIG. 6, in the case of the input signal InR(k) and the input signal InL(k) obtained by recording sound wave from 80 deg, the coefficient m(k) converges toward 1. Conversely, as illustrated in FIG. 7, when a sound source is present in a 270-deg direction, the coefficient m(k) converges toward substantially 0.1. In addition, as illustrated in FIG. 8, when a sound source is present in a 0-deg direction, the coefficient m(k) converges toward substantially 0.75. Still further, as illustrated in FIG. 9, when there is a sound source in a 30-deg direction, the coefficient m(k) converges toward substantially 0.94.

Hence, a gain that relatively emphasizes the output signal OutL(k) and the signal OutInR(k) by the coefficient m(k) can be obtained, and the closer the location of the sound source to the 80-deg direction is, the closer to 1 the coefficient m(k) becomes. Conversely, a gain that relatively suppresses by the coefficient m(k) can be obtained, and the more the location is apart from the 80-deg direction, the smaller the coefficient m (k) becomes which is smaller than 1.

Next, the purpose of the interchanging circuit will be explained. Through the interchanging circuit, the coefficient updating circuit alternatively calculates the following formulae (7).

When k is an odd number $$m(k)=m(k-1)\times\beta+(-m(k-1)\times InL(k)^2+InL(k)\times InR(k))\times\mu$$

When k is an even number $$m(k)=m(k-1)\times\beta+(-m(k-1)\times InR(k)^2+InR(k)\times InL(k))\times\mu \quad (7)$$

In the formulae (7), the square term of a signal acts so as to decrease the uncorrelated components like white noises as time advances. Conversely, the adjacent term is equivalent to the numerator part of the following formula (8) that sequentially calculates the correlation coefficient, and the effect of the correlation component is reflected on the coefficient m.

$$R(n) = R(n-1)\times\partial+\frac{x\times y}{|x||y|}(1-\partial) \quad (8)$$

That is, when the coefficient updating circuit 3 attempts to approximate the input signal InR(k) to the input signal InL(k), the uncorrelated components of the input signal InL(k) tend to be amplified, and the uncorrelated components of the input signal InR(k) tend to be suppressed. In addition, when it is attempted to approximate the input signal InL(k) to the input signal InR(k), the uncorrelated components of the input signal InR(k) tend to be amplified, and the uncorrelated components of the input signal InL(k) tend to be suppressed.

Hence, when the interchanging circuit 2 is placed at the forward stage of the coefficient updating circuit 3, an operation of approximating the input signal InR(k) to the input signal InL(k) and performing a synchronous addition, and an operation of approximating the input signal InL(k) to the input signal InR(k) and performing a synchronous addition are alternately repeated. Hence, the operations of amplifying and suppressing the uncorrelated components are canceled with each other, and the effect of the correlation component is well reflected on the coefficient m(k).

Figure 10:
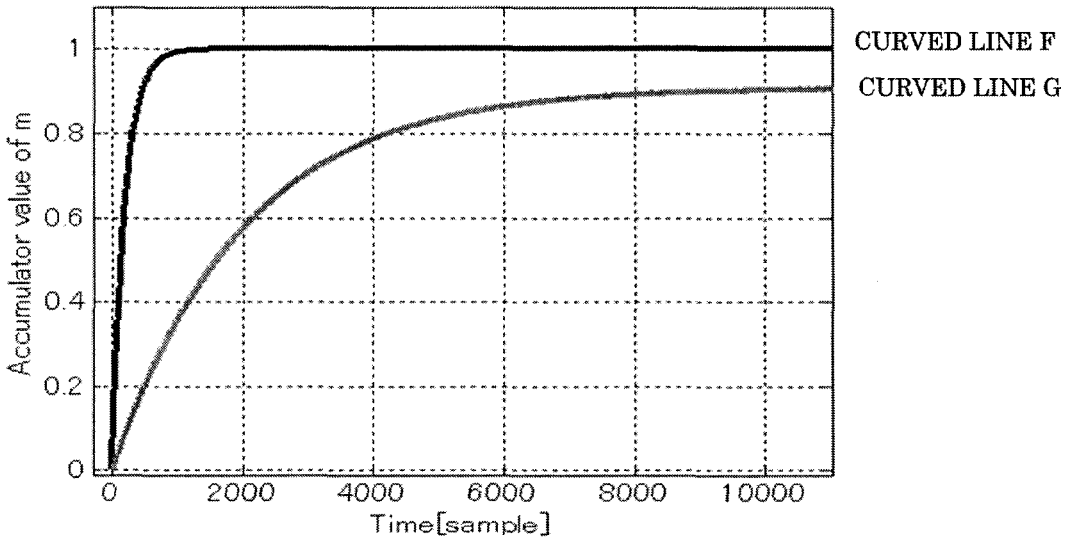
FIG. 10 is a graph showing a converging speed of a coefficient m(k) in accordance with the presence/absence of an interchanging circuit.

FIG. 10 shows the way of convergence of the coefficient m(k) when there is the interchanging circuit 2 and when there is no interchanging circuit. As to both convergence conditions, a sound source was disposed at the center position, and sound was collected by the microphones L and R. As is indicated by a curved line F in FIG. 10, when there was the interchanging circuit 2, the coefficient m(k) converged toward 1 at the substantially 1000th sampling time, but as indicated by a curved line G, when there was no interchanging circuit 2, although the coefficient m(k) was updated by 10000 times, the coefficient did not converge to 1 yet, and the difference between those cases was 10 times. That is, it is indicated that a sound-source separation can be completed quickly when there is the interchanging circuit 2.

(Effects)

As explained above, according to the sound-source separation device of this embodiment, a filtering containing a delay by a specific time is performed on either the one of the pair of input signals input from the microphones L and R. Next, after the filtering, the pair of input signals InL(k) and InR(k) input from the microphones L and R is alternately interchanged by the interchanging circuit 2 for each sampling, and thus the pair of interchanged signals InA(k) and InB(k) is generated. Subsequently, the error signal between the interchanged signals InA(k) and InB(k) is generated by multiplying either one of the interchanged signals InA(k) and InB(k) by the coefficient m. Still further, the recurrence formula of the coefficient m containing the error signal is calculated, and the coefficient m is updated for each sampling. Eventually, the pair of input signals is multiplied by the sequentially updated coefficient m, and output.

For example, by causing the input signal to pass through the filter 1*a* that has the transfer function T1 which gives a delay of the specific time, the filtering is performed on either one of the pair of input signals InL(k) and InR(k). This transfer function T1 substantially satisfies a condition T1×C11=C12 where C11 is the transfer function of sound wave from the sound source S1 to the microphone that outputs the input signal subjected to the filtering, and C12 is the transfer function of the sound wave to the other microphone.

Either one interchanged signal is caused to pass through the integrator 5 set with −1 time of the past coefficient m calculated one sampling before, and after through the integrator 5, the pair of interchanged signals is caused to pass through the adder 6 that adds both interchanged signals. After through the adder 6, the addition signal is caused to pass through the integrator 7 set with the constant μ, and after through the integrator, the resultant signal is caused to pass through the integrator 8 set with the one interchanged signal prior to the multiplication by the past coefficient m. After through the integrator 8, the resultant signal is caused to pass through the adder 9 set with the past coefficient m calculated one sampling before. Accordingly, the coefficient m is updated for each sampling.

Hence, the sound-source separation apparatus of this embodiment focuses on the time difference caused due to the physical disposing position of the target sound source 1 and those of the microphones L and R, avoids a complex calculation. In addition, even if a phase difference and an amplitude difference between the input signal In(L) and the input signal In(R) are quite small, or conversely, the time difference is equal to or larger than a cycle, the directivity can be easily formed to the target sound S1 in the specific direction out of the center position of the microphones L and R without an analysis.

Still further, the directivity formation can be realized by the interchanging circuit and the one coefficient updating circuit that calculates the recurrence formula without depending on a filter, etc., with a large tap number. Hence, the number of calculations can be remarkably reduced, and the final delay can be set within several ten micro-seconds to several mili-seconds.

The specific direction in which the directivity is formed in this embodiment is merely an example. Needless to say, the specific direction can be set freely in accordance with the adjustment of the transfer function T1 and the selection of the microphone L or R to be equipped with the filter 1*a*.

(Second Embodiment)

(Structure)

Figure 11:
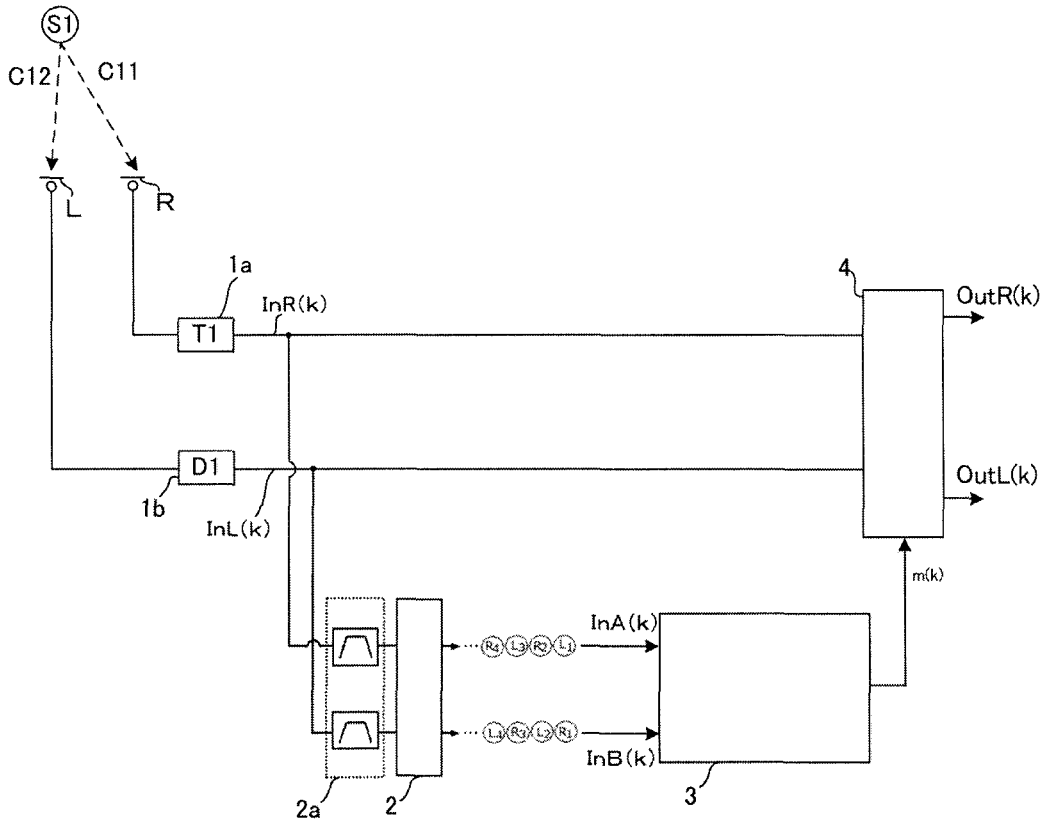
FIG. 11 is a block diagram illustrating a structure of a sound-source separation apparatus according to a second embodiment.

A sound-source separation apparatus according to a second embodiment includes, as illustrated in FIG. 11, in addition to the filter 1*a* provided at the subsequent stage of the microphone R, a delay 1*b* provided at the subsequent stage of the microphone L. The delay 1*b* is an LC circuit, etc., and gives a certain delay time to the input signal InL(k).

The delay time by the delay 1*b* is set to be equal to or longer than a necessary time for sound wave to travel the distance between the microphones L and R. When the target sound source S1 is present in the 270-deg direction, the difference in reaching time of the sound wave to the microphones L and R becomes the maximum, and the microphone L receives the sound wave before the microphone R. The delay 1*b* delays the input signal InL(k) by equal to or loner than this maximum time. That is, the input signal InR(k) is always advanced in time waveform more than that of the input signal InL(k).

A transfer function D1 of the delay 1*b* and the transfer function T1 of the filter 1*a* are adjusted so as to satisfy the following formula (9). That is, the transfer function T1 is adjusted so as to eliminate a time difference in sound wave coming from the specific direction in consideration of the delay of the input signal InL(k) by the delay 1*b*.

$$C11 \times T1 = D1 \times C12 \tag{9}$$

(Action)

The positional relationship model in FIG. 3 is now considered. According to the sound-source separation apparatus of the second embodiment, the time waveform of the input signal InL(k) output by the microphone L is shifted by the delay 1*b* so as to be delayed. The shifting amount is set to be the time difference of the same sound wave that reaches the microphones L and R from 270 deg.

Figure 12:
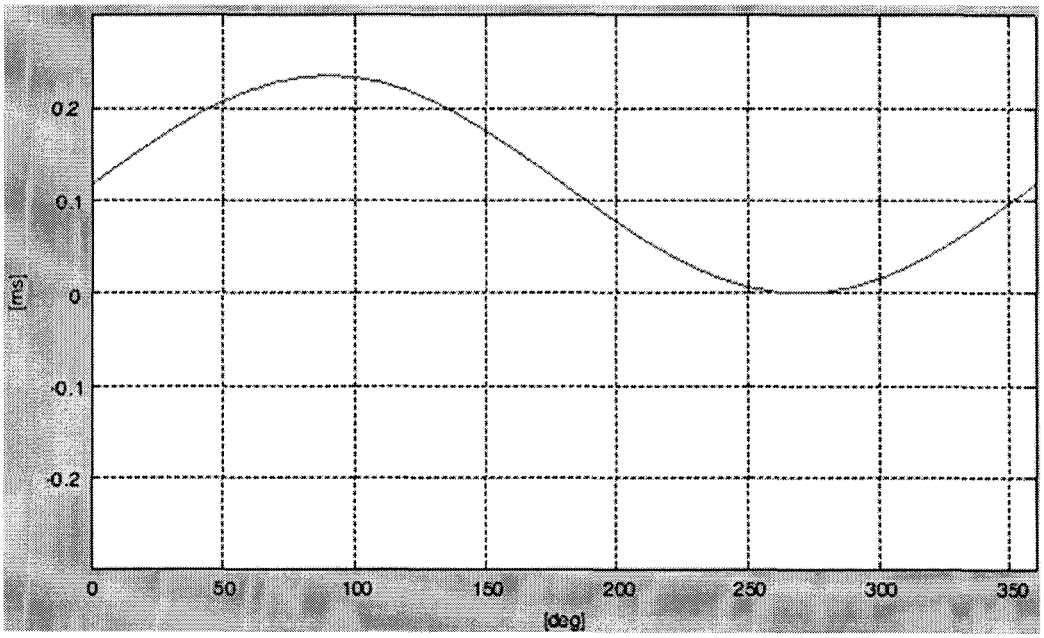
FIG. 12 is a graph showing a change in difference in reaching time due to a delay.

In this case, as illustrated in FIG. 12, the time difference until the same sound wave reaches the microphone L after reaching the microphone R always becomes a positive value that is equal to or greater than zero. That is, no matter where the target sound source S1 is located, the input signal InR(k) of the sound wave therefrom is advanced in time waveform by equal to or greater than zero in comparison with the input signal InL(k) of this sound wave.

Figure 13:
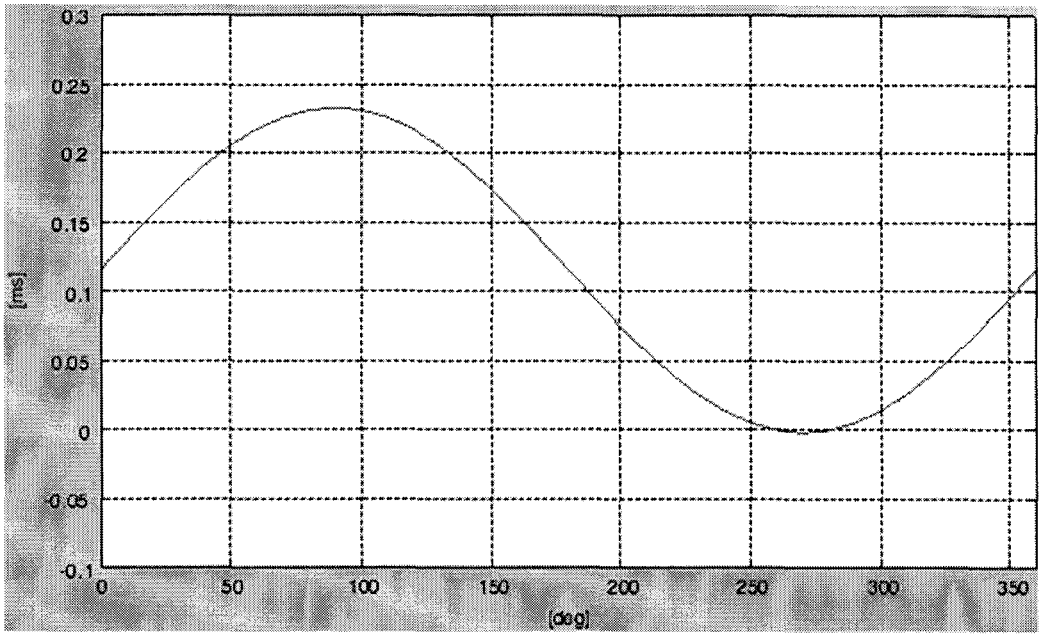
FIG. 13 is a graph showing a change in difference in reaching time by a filter after delayed.

Hence, the time waveform of the input signal InR(k) output by the microphone R is shifted so as to be delayed. The shifting amount is set to be the time difference of the sound wave that reaches the microphones L and R from 280 deg based on a presumption that the target sound source S1 is present in 280 deg. In this case, as illustrated in FIG. 13, the input signal InL(k) and the input signal InR(k) obtained by recording the sound wave from 280 deg have a time difference that is zero.

Likewise, when the transfer function T1 of the filter 1*a* satisfies the above-explained formula (9), InR(k) and InL(k) which have come from 280 deg and which are output by the microphones L and R are adjusted so as to have the same amplitude and the same phase in time waveform, and the time difference is eliminated. Hence, those signals are relatively emphasized.

(Effects)

As explained above, according to this sound-source separation apparatus, the one of the pairs of input signals is caused to pass through the filter 1*a*, while the other one of the pair of input signals is caused to pass through the delay 1*b*. Hence, a delay time that is equal to or longer than the necessary time for the sound wave to travel the distance between the microphones L and R is caused in the other one of the pair of input signals. Next, the filter 1*a* performs filtering that considers the time delay obtained by adding the delay time by the delay 1*b* and the time difference of the sound wave which comes from the target sound source S. More specifically, it is appropriate if the transfer function T1 of the filter 1*a* and the transfer function D1 of the delay 1*b* substantially satisfy a condition T1×C11=D1×C12. Hence, no matter where the target sound source S1 is located, the sound wave from this target sound source S can be relatively emphasized.

The specific direction in which the directivity is formed in this embodiment is merely an example. Needless to say, the specific direction can be set freely in accordance with the adjustment of the transfer function T1, that of the transfer function D, and the selection of the microphones L and R to be equipped with the filter 1*a*.

(Third Embodiment)

A sound-source separation apparatus of a third embodiment generates, in addition to the action of the first embodiment or the second embodiment, a synthesized signal InC(k) obtained by adjusting the time difference and amplitude difference of sound wave coming from a noise source N1 to be zero, and subtracting from the one of the pair of input signals, and a gain process is performed on the synthesized signal InC(k) by the synthesizing circuit 4, thereby relatively enhancing the sensitivity to the target sound source S1 in the specific direction, and further emphasizing sound wave from this target sound source S1.

Figure 14:
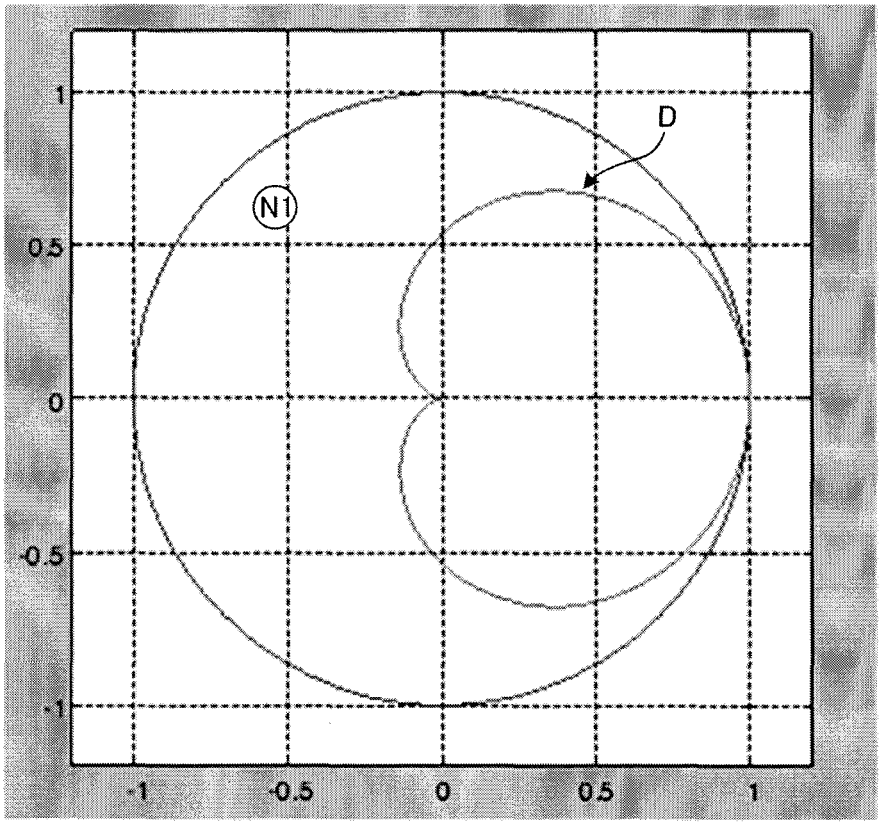
FIG. 14 illustrates a range of directivity according to a third embodiment.

FIG. 14 illustrates as range of the directivity reflected on the synthesized signal InC(k). As illustrated in FIG. 14, signal processing is performed on the input signal InL(k) and the input signal InR(k) input from the microphones L and R to form a cardioid type directivity range D.

Figure 15:
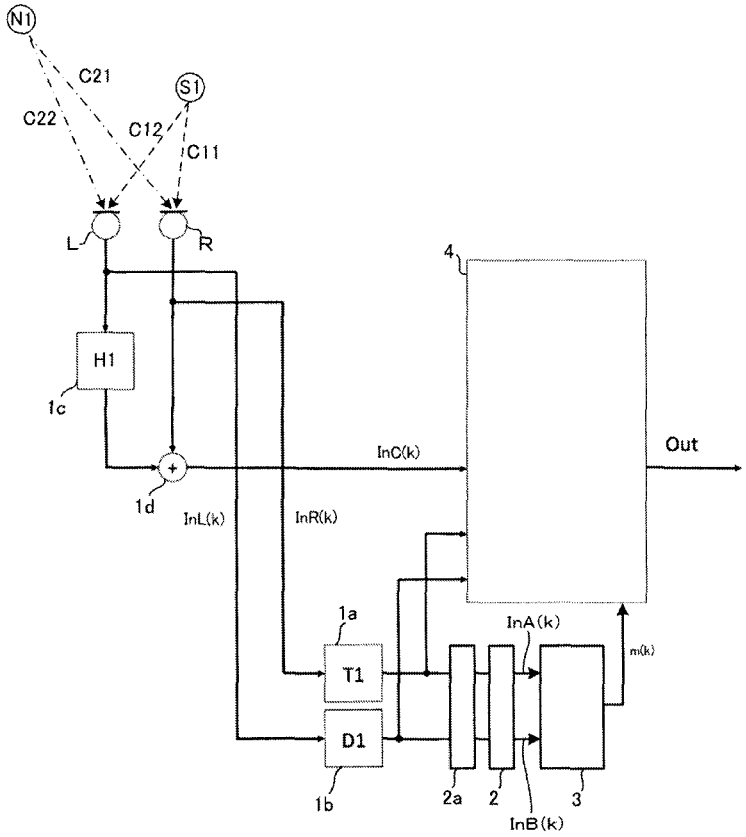
FIG. 15 is a block diagram illustrating a structure of a sound-source separation apparatus according to the third embodiment.

As illustrated in FIG. 15, this sound-source separation apparatus includes a filter is which is provided at the subsequent stage of the microphone L and which is branched from the route to the delay 1*b* when it is desirable to suppress sound wave from the center position between the microphones L and R toward 270 deg. The signals output by the filter 1*c* and the microphone R are input to the synthesizing circuit 4 as the synthesizing signal InC(k) through an adder 1*d*.

A transfer function H1 of the filter 1*c* satisfies the following formula (10). A transfer function from the noise source N1 to the microphone R is C21, and a transfer function from the noise source N1 to the microphone L is C22.

$$H1 \cong -C21/C22 \tag{10}$$

As is indicated by the formula (10), when the input signal InL(k) passes through the filter 1*c*, the input signal InL(k) that comes from the noise source N1 and an input signal (R) satisfy a relationship in which the phase is the same but the positive and negative signs of the amplitude are inverted. Hence, through the adder 1*d*, the smaller the time difference is, the more those input signal InL(k) and the input signal (R) are canceled with each other, and thus the synthesized signal InC(k) that has suppressed sound wave in the 270-deg direction can be generated.

The synthesized signal InC(k) is an output with a directivity that has a low sensitivity in the set direction, and by multiplying the synthesized signal InC(k) by m(k) at an arbitrary ratio, an output Out that has a further intensive directivity can be obtained in comparison with the first embodiment and the second embodiment.

(Other Embodiments)

As explained above, several embodiments of the present disclosure were shown, but those embodiments are merely presented as examples, and are not intended to limit the scope of the present disclosure. Those novel embodiments can be carried out in various other forms, and various omissions, replacements, and modifications can be made thereto without departing from the scope of the present disclosure. Those embodiments and modifications thereof are within the scope and spirit of the present disclosure, and are also within the aspects of the claimed invention and the equivalent range thereto.

For example, in the above-explained embodiment, the explanation was given based on the presumption that the sound-source separation apparatus is provided in a device, such as an IC recorder or a mobile terminal that has a recording function, but can be provided in all other acoustic devices, and instead of the microphones, the input signals In(L) and In(R) may be provided from a memory that stores sound wave data. That is, the expression "a directivity in a specific direction is formed relative to a pair of input signal input from a pair of microphones" means to form a directivity in a specific direction relative to, in addition to the input signals input from the microphones in real time, input signals obtained by recording in advance using a pair of microphones connected with the sound-source separation apparatus, input signals obtained by recording in advance using a pair of completely different microphones, and simulated input signals generated as resembling sound wave recorded by a pair of microphones using a computer, etc.

Figure 16:
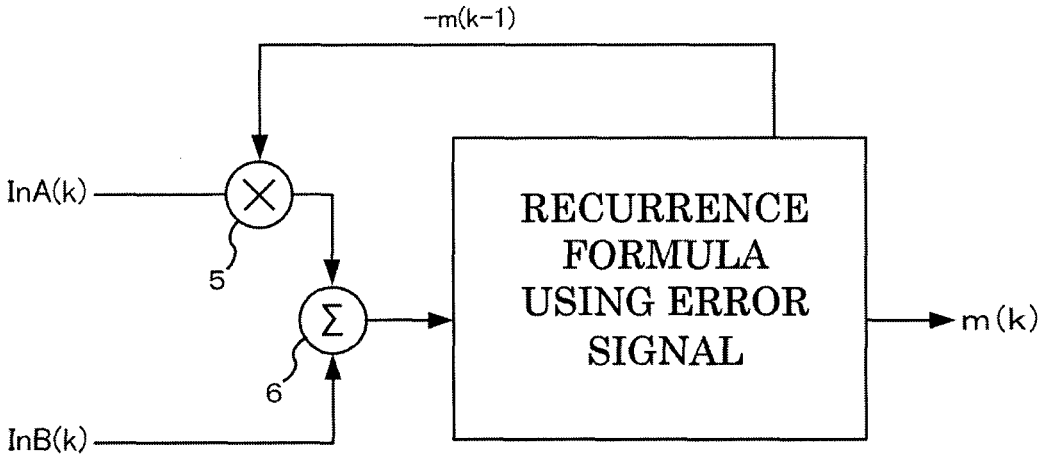
FIG. 16 is a block diagram illustrating a structure of a sound-source separation apparatus according to the other embodiment.

In addition, as illustrated in FIG. 16, the coefficient updating circuit is not limited to the above-explained embodiments, and can be realized in various other forms as long as such a circuit multiplies the one interchanged signal by the coefficient m, generates the error signal of the interchanged signals, calculates the recurrence formula of the coefficient m containing this error signal, and updates the coefficient m for each sampling.

Still further, this sound-source separation apparatus may be realized as the software process by a CPU and a DSP, or may be constructed by a dedicated digital circuit. When realized as the software process, in a computer that includes a CPU, an external memory, and a RAM, a program described with the same process details as those of the filter 1*a*, the delay 1*b*, the filter 1*c*, the adder 1*e*, the interchanging circuit 2, the coefficient updating circuit 3, and the synthesizing circuit 4 may be stored in a ROM or an external memory, such as a hard disk or a flash memory, extracted in the RAM as needed, and the CPU may perform arithmetic processing in accordance with this program.

The invention claimed is:

1. A sound-source separation method of forming a directivity in a specific direction relative to a pair of sampled input signals, the method comprising:

a filtering step of performing filtering containing a delay by a specific time on one of the pair of sampled input signals;

an interchanging step of, after the filtering step, alternately interchanging the pair of sampled input signals through an interchanging circuit for each sampling, and generating a pair of interchanged signals;

a generating step of multiplying one of the interchanged signals by a coefficient m, and generating an error signal between the interchanged signals;

an updating step of calculating a recurrence formula of the coefficient m containing the error signal, and updating the coefficient m for each sampling; and an outputting step of multiplying the pair of sampled input signals by the sequentially updated coefficient m and outputting resultant signals, wherein:

the specific time in the filtering step is equivalent to a time difference of sound wave that reaches a pair of microphones from the specific direction; and in the filtering step, the pair of sampled input signals originating from the sound wave from the specific direction is adjusted so as to have a same amplitude and a same phase.

2. The sound-source separation method according to claim 1, wherein:

in the filtering step, filtering is performed on the one of the pair of sampled input signals by a transfer function T1 that delays the sampled input signal by the specific time; and when a transfer function of sound wave from the specific direction to the microphone which outputs the sampled input signal subjected to filtering is C11, and a transfer function of the sound wave to the other microphone is C12, the transfer function T1 substantially satisfies T1×C11=C12.

3. The sound-source separation method according to claim 1, further comprising a delaying step of causing, to the other one of the pair of sampled input signals, a delay time that is equal to or longer than a necessary time for sound wave to travel a distance between the pair of microphones, wherein in the filtering step, filtering is performed on the one of the pair of sampled input signals, the filtering containing a time delay obtained by adding the delay time by the delaying step and the specific time.

4. The sound-source separation method according to claim 3, wherein:

in the filtering step, filtering is performed on the one of the pair of sampled input signals by a transfer function T1 that delays the sampled input signal by a specific time;

in the delaying step, the other one of the pair of sampled input signals is delayed by a transfer function D1 that delays the sampled input signal by the delay time; and when a transfer function of sound wave from the specific direction to the microphone which outputs the sampled input signal subjected to filtering is C11, and a transfer function of the sound wave to the other microphone is C12, the transfer function T1 and the transfer function D1 substantially satisfy T1×C11=D1×C12.

5. The sound-source separation method according to claim 1, wherein in the generating and updating steps:

one of the interchanged signals is caused to pass through a first integrator set with −1 time of a past coefficient m calculated one sampling before;

after through the first integrator, the pair of interchanged signals is caused to pass through a first adder that adds those signals;

after through the first adder, the addition signal is caused to pass through a second integrator set with a constant μ;

after through the second integrator, a resultant signal is caused to pass through a third integrator set with the one interchanged signal before multiplied by the past coefficient m; and after through the third integrator, a resultant signal is caused to pass through a second adder set with a past coefficient m calculated one sampling before, thereby updating the coefficient m for each sampling.

6. A sound-source separation apparatus forming a directivity in a specific direction relative to a pair of sampled input signals, the apparatus comprising:

a filter filtering containing a delay by a specific time on the one of the pair of sampled input signals;

an interchanger alternately interchanging, after the filtering, the pair of sampled input signals for each sampling, and generating a pair of interchanged signals;

an error signal generator multiplying one of the interchanged signals by a coefficient m, and generating an error signal between the interchanged signals;

a recurrence formula calculator calculating a recurrence formula of the coefficient m containing the error signal, and updating the coefficient m for each sampling; and an integrator multiplying the pair of sampled input signals by, the sequentially updated coefficient m and outputting resultant signals, wherein:

the specific time in the filtering is equivalent to a time difference of sound wave that reaches a pair of microphones from the specific direction; and in the filtering, the pair of sampled input signals originating from the sound wave from the specific direction is adjusted so as to have a same amplitude and a same phase.

7. The sound-source separation apparatus according to claim 6, wherein:

the filter performs filtering on the one of the pair of sampled input signals by a transfer function T1 that delays the sampled input signal by the specific time; and when a transfer function of sound wave from the specific direction to the microphone which outputs the sampled input signal subjected to filtering is C11, and a transfer function of the sound wave to the other microphone is C12, the transfer function T1 substantially satisfies T1×C11=C12.

8. The sound-source separation apparatus according to claim 6, further comprising a delay that causes, to the other one of the pair of sampled input signals, a delay time that is equal to or longer than a necessary time for sound wave to travel a distance between the pair of microphones, wherein the filter performs filtering on the one of the pair of sampled input signals, the filtering containing a time delay obtained by adding the delay time by the delaying step and the specific time.

9. The sound-source separation apparatus according to claim 8, wherein:

the filter performs filtering on the one of the pair of sampled input signals by a transfer function T1 that delays the sampled input signal by a specific time;

the delay delays the other one of the pair of sampled input signals by a transfer function D1 that delays the sampled input signal by the delay time; and when a transfer function of sound wave from the specific direction to the microphone which outputs the sampled input signal subjected to filtering is C11, and a transfer function of the sound wave to the other microphone is C12, the transfer function T1 and the transfer function D1 substantially satisfy T1×C11=D1×C12.

10. The sound-source separation apparatus according to claim 6, wherein the error signal generator and the recurrence formula calculator:

cause one of the interchanged signals to pass through a first integrator set with −1 time of a past coefficient m calculated one sampling before;

after through the first integrator, cause the pair of interchanged signals to pass through a first adder that adds those signals;

after through the first adder, cause the addition signal to pass through a second integrator set with a constant μ;

after through the second integrator, cause a resultant signal to pass through a third integrator set with the one interchanged signal before multiplied by the past coefficient m; and after through the third integrator, cause a resultant signal to pass through a second adder set with a past coefficient m calculated one sampling before, thereby updating the coefficient m for each sampling.

11. A non-transitory computer-readable recording medium having instructions stored thereon, which when executed by a processor, causes the processor to perform a method of forming a directivity in a specific direction relative to a pair of sampled input signals, comprising:

a filtering step of performing filtering containing a delay by a specific time on one of the pair of sampled input signals;

an interchanging step of, after the filtering step, alternately interchanging the pair of sampled input signals through an interchanging circuit for each sampling, and generating a pair of interchanged signals;

a generating step of multiplying one of the interchanged signals by a coefficient m, and generating an error signal between the interchanged signals;

an updating step of calculating a recurrence formula of the coefficient m containing the error signal, and updating the coefficient m for each sampling; and an outputting step of multiplying the pair of sampled input signals by the sequentially updated coefficient m and outputting resultant signals, wherein:

the specific time in the filtering step is equivalent to a time difference of sound wave that reaches a pair of microphones from the specific direction; and in the filtering step, the pair of sampled input signals originating from the sound wave from the specific direction is adjusted so as to have a same amplitude and a same phase.

12. The non-transitory computer-readable recording medium according to claim 11, wherein:

in the filtering step, filtering is performed on the one of the pair of sampled input signals by a transfer function T1 that delays the sampled input signal by the specific time; and when a transfer function of sound wave from the specific direction to the microphone which outputs the sampled input signal subjected to filtering is C11, and a transfer function of the sound wave to the other microphone is C12, the transfer function T1 substantially satisfies T1×C11=C12.

13. The non-transitory computer-readable recording medium according to claim 11, further comprising a delaying step of causing, to the other one of the pair of sampled input signals, a delay time that is equal to or longer than a necessary time for sound wave to travel a distance between the pair of microphones, wherein in the filtering step, filtering is performed on the one of the pair of sampled input signals, the filtering containing a time delay obtained by adding the delay time by the delaying step and the specific time.

14. The non-transitory computer-readable recording medium according to claim 13, wherein:

in the filtering step, filtering is performed on the one of the pair of sampled input signals by a transfer function T1 that delays the sampled input signal by a specific time;

in the delaying step, the other one of the pair of sampled input signals is delayed by a transfer function D1 that delays the sampled input signal by the delay time; and when a transfer function of sound wave from the specific direction to the microphone which outputs the sampled input signal subjected to filtering is C11, and a transfer function of the sound wave to the other microphone is C12, the transfer function T1 and the transfer function D1 substantially satisfy T1×C11=D1×C12.

15. The non-transitory computer-readable recording medium according to claim 11, wherein in the generating and updating steps:

one of the interchanged signals is caused to pass through a first integrator set with −1 time of a past coefficient m calculated one sampling before;

after through the first integrator, the pair of interchanged signals is caused to pass through a first adder that adds those signals;

after through the first adder, the addition signal is caused to pass through a second integrator set with a constant μ;

after through the second integrator, a resultant signal is caused to pass through a third integrator set with the one interchanged signal before multiplied by the past coefficient m; and after through the third integrator, a resultant signal is caused to pass through a second adder set with a past coefficient m calculated one sampling before, thereby updating the coefficient m for each sampling.

* * * * *